US006921189B2

(12) United States Patent
Blackhurst

(10) Patent No.: US 6,921,189 B2
(45) **Date of Patent: *Jul. 26, 2005**

(54) BARREL MIXER

(75) Inventor: Ronald Samuel Blackhurst, Nr Buxton (GB)

(73) Assignee: Belle Engineering (Sheen) Limited (GB)

( * ) Notice: Subject to any disclaimer, the term of this patent is extended or adjusted under 35 U.S.C. 154(b) by 0 days.

This patent is subject to a terminal disclaimer.

(21) Appl. No.: 10/424,427

(22) Filed: Apr. 28, 2003

(65) Prior Publication Data

US 2003/0202419 A1 Oct. 30, 2003

Related U.S. Application Data

(63) Continuation of application No. 09/805,786, filed on Mar. 13, 2001, which is a continuation of application No. 09/294,215, filed on Apr. 16, 1999, now Pat. No. 6,220,744, which is a continuation of application No. PCT/GB97/02840, filed on Oct. 15, 1997.

(30) Foreign Application Priority Data

Oct. 17, 1996 (GB) ..... 9621632

(51) Int. Cl.[7] ..... B28C 5/18
(52) U.S. Cl. ..... 366/47; 366/62
(58) Field of Search ..... 366/45–48, 54, 366/62, 63, 185, 220

(56) References Cited

U.S. PATENT DOCUMENTS

| | | | | |
|---|---|---|---|---|
| 1,453,323 | A | | 5/1923 | Palmeter |
| 1,863,029 | A | * | 6/1932 | Pispanen |
| 2,452,896 | A | * | 11/1948 | Bonney et al. |
| 2,563,669 | A | | 8/1951 | Ahearn |
| 2,573,296 | A | | 10/1951 | Arant |
| 3,424,440 | A | | 1/1969 | Upham et al. |
| 3,879,020 | A | | 4/1975 | Ray |
| 4,060,225 | A | | 11/1977 | Cunningham |
| 4,197,015 | A | | 4/1980 | Moser et al. |
| 4,223,997 | A | | 9/1980 | Violet et al. |
| 4,294,548 | A | | 10/1981 | Watson |
| 5,492,401 | A | | 2/1996 | Halsted |
| 6,220,744 | B1 | * | 4/2001 | Blackhurst |

FOREIGN PATENT DOCUMENTS

| | | | |
|---|---|---|---|
| DE | 860 194 C | | 12/1952 |
| EP | 0450214 | | 10/1991 |
| GB | 880034 | | 10/1961 |
| GB | 1067365 | | 5/1967 |
| GB | 1 504 934 | | 3/1978 |
| GB | 2 187 395 A | * | 9/1987 |
| GB | 2214100 | | 8/1989 |
| SU | 1743886 A | | 6/1992 |
| WO | WO 98/17451 | | 4/1998 |

OTHER PUBLICATIONS

International Search Report mailed Feb. 13, 1998 for PCT Application No. PCT/GB97/02840.

(Continued)

*Primary Examiner*—David Sorkin
(74) *Attorney, Agent, or Firm*—Wallenstein Wagner & Rockey, Ltd.

(57) ABSTRACT

There is disclosed a barrel mixer (11) comprising a support (12) for a rotary mixer barrel (13), including a tipping arrangement (14) for said barrel (13) limiting tipping between a mixing position in which the barrel (13) is angled so as to retain its contents and a tipping position in which the barrel (13) is angled so that its contents are poured out, a motor (15) and transmission (16) mounted on said support (12) for rotating the barrel including step-down gearing between the motor (15) and the barrel (13), the motor (15) and gearing (33) tipping with the barrel (13), the motor shaft (15*b*) being, at an intermediate position between mixing and tipping positions of the barrel (13), vertical, and the motor (15) being of a type having a mounting plate (31) surrounding the motor shaft (15*b*).

8 Claims, 3 Drawing Sheets

OTHER PUBLICATIONS

European Search Report completed Jun. 11, 2003 for European Application No. EP 03 00 6106.

Sales Brochure, "The Benford TIP–UP ½ Bag Size concrete mortar & plaster mixer—Tips up to discharge . . . Tips back to fill and mix!—It's the mixer for everyman . . . and his transport!, " Benford Ltd., Mar. 1973, pp. 1–2.

Sales Brochure, At work–The Baromix Minor–The Business of Mixing With Pleasure," pp. 1–2, (published prior to Oct. 17, 1996).

Sales Brochure, "Mini Mixer Range–The best selling mixer for construction and rental –Mini 150–140 Ltr –Mini 140–140 Ltr," Belle Engineering (Sheen) Limited, pp. 1–2, (published in 1994).

Sales Brochure, "Mini 150 Concrete Mixer 120/90 Litres (4/3 Cu. ft) –Performance, Safety and Portability –The Perfect Mix," Belle Engineering (Sheen) Ltd., pp. 1–2, (published in 1992).

Sales Brochure, "Baromix Concrete Mixers and Powerbarrows," pp. 1–3, (published prior to Oct. 17, 1996).

Sales Brochure, Instrukcja Obslugi I Montazu Betoniarki TYP MU–50R; Herco Limited, 1 page, (published prior to Oct. 17, 1996).

Sales Brochure, "Handy 85'," Midequip Ltd., 1 page, (published prior to Oct. 17, 1996).

Sales Brochure, Mixer "Eta Beta" Betonmischer "Eta Beta", Imer International S.p.A., pp. 1–2, (published prior to Oct. 17, 1996).

Sales Brochure, "Belle Bildamix," Belle Engineering Ltd., 1 page, (published prior to 1989).

Sales Brochure, Baromix Minor–The Baromix Minor 120/90 litres (4/3 cu. ft.), Baromix Limited, pp. 1–2, (published prior to Oct. 17, 1996).

* cited by examiner

BARREL MIXER

RELATED APPLICATIONS

This is a continuation application of co-pending U.S. Pat. application Ser. No. 09/805,786, filed Mar. 13, 2001, which is a continuation of U.S. Pat. application Ser. No. 09/294,215, filed Apr. 16, 1999, now U.S. Pat. No. 6,220,744, which is a continuation of International Patent Application No. PCT/GB97/02840, filed Oct. 15, 1997, claiming priority from British Application No. 9621632.0, filed Oct. 17, 1996.

TECHNICAL FIELD

This invention relates to an assembly for barrel mixers such as are mainly used for mixing cement and, in particular, to such mixers designed for light or medium duty mixing and adapted for single-handed movement and operation.

BACKGROUND OF THE INVENTION

Conventional mixers are powered by electric motors or by internal combustion engines, usually small, petrol-driven motors driving the rotary mixing barrel through reduction gearing. Over the decades during which mixers of this kind have been commercially available, the design of the barrel support arrangements and the motor transmission arrangements have been refined with a view to reducing the weight but improving the robustness and efficiency, always with the intention of reducing the cost and increasing the value-for-money of the mixers, to the point where it is difficult to see what further savings can be made for any particular specification.

The present invention, however, makes possible substantial cost savings. Features of preferred arrangements facilitated by the invention give rise to further advantages. A preferred embodiment will be disclosed and the novel aspects of the present invention will be particularly identified and discussed herein.

SUMMARY OF THE INVENTION

The invention comprises in one aspect a barrel mixer comprising a support for a rotary mixer barrel, including a tipping arrangement for said barrel limiting tipping between a mixing position in which the barrel is angled so as to retain its contents and a tipping position in which the barrel is angled so that its contents are poured out, a motor and transmission mounted on said support for rotating the barrel including step-down gearing between the motor and the barrel, the motor and gearing tipping with the barrel, the motor shaft being, at an intermediate position between mixing and tipping positions of the barrel, vertical, and the motor being of a type having a mounting plate surrounding the motor shaft.

The motor may comprise an internal combustion engine, which may be of the type adapted to power rotary mowers, or an electric motor, which may be of the open frame type adapted to power washing machines. So that the same design may be used, simplifying manufacturing, for both electric motors and internal combustion engines, the mixing and tipping positions may be arranged to be within the limits for operation of a vertical axis lawn mower motor.

The orientation of an electric motor, of course, makes no difference to its operation, but if tipping is limited, no matter what engine is used, only one design of support needs to be made, saving on design, manufacturing and inventory costs.

There is, of course, no fundamental difference between these types of motors and any other; it is simply a question of design to suit a given purpose. That having been said, the lawn mower motor and the washing machine motor were designed to perform particular tasks and to suit particular pieces of machinery. Conventional general purpose motors with conventional mounts have been the engineers' choice for most other pieces of equipment.

It is surprising, therefore, to find that by the invention the cost of barrel mixers can be significantly reduced, while retaining, even enhancing, all the desirable features of conventional barrel mixers, and this is the more surprising since both barrel mixers and motors of the kind with which the invention is concerned have coexisted for decades without it ever having been suggested that the motor could be or should be used in the mixer, far less any attempt having been made to exploit the combination commercially. It is all the more surprising when it is realized that motors of this type, by virtue of their widespread use in lawn mowers and washing machines, are commercially available at a significant discount over the general purpose motors.

In any event, these motors are found to lend themselves entirely appropriately to barrel mixers, each of which has its own advantages over and above the overall cost reduction due to the lower motor price.

In another aspect, the invention comprises a barrel mixer comprising a support for rotary mixer barrel, a motor mounted on said support and transmission for rotating the barrel, the transmission including a gear ring on the barrel with inwardly facing gear teeth, the motor and transmission being contained, viewed axially of the barrel, within the circumference of the barrel.

The motor may, again, be of the type having a mounting plate surrounding the motor shaft.

The motor may be mounted with its axis parallel to the axis of rotation of the barrel. The motor may then be mounted in a mounting plate and drive the barrel through gearing which is axially parallel the motor and the barrel. The barrel may have a large diameter (i.e., at or near the outer radius of the barrel) drive ring with radially inwardly directed teeth meshing with a cog driven directly or indirectly by the motor. The cog may be driven by a belt drive from the motor shaft, or by an intermediate cog.

The motor, however, may be mounted with its axis at right angles to the direction of the axis of rotation of the barrel.

The motor may be mounted in a first mounting plate or frame of the support with its shaft projecting through said plate or frame, and the barrel mounted on a second mounting plate or frame by means of a right-angle gear (i.e., a gear whose output and input shafts are at right angles) connected directly or indirectly to the motor shaft. The right-angle gear may comprise a worm gear.

The motor shaft, as before, may be connected by a belt drive or by meshing cogs to the right-angle gear.

The support means may comprise a wheeled trolley, which may comprise a frame having wheels mounted on a frame base, a support for the barrel supporting the barrel on the same side of the frame as the frame base and supporting the motor and transmission on the opposite side of the frame, and handle means projecting from the frame at the opposite end thereof to the frame base and on the same side of the frame as the motor and transmission.

The frame base may comprise a rest extending on the motor and transmission side of the frame on which (and the wheels), the mixer rests with the barrel axis inclined upwardly for mixing and, beyond the wheels, a foot on to which the mixer can be tipped for pouring.

The support may additionally comprise a stand with a pintle bearing receiving the trolley and having a tipping arrangement allowing the support to be tipped on the pintle bearing between mixing and pouring positions.

The barrel may be demountable from the support, and the support break down to fit inside the barrel for stowage and transportation.

BRIEF DESCRIPTION OF THE DRAWINGS

Embodiments mixers according to the invention will no be described with reference to the accompanying drawings, in which.

DETAILED DESCRIPTION OF PREFERRED EMBODIMENTS

Figure 2:
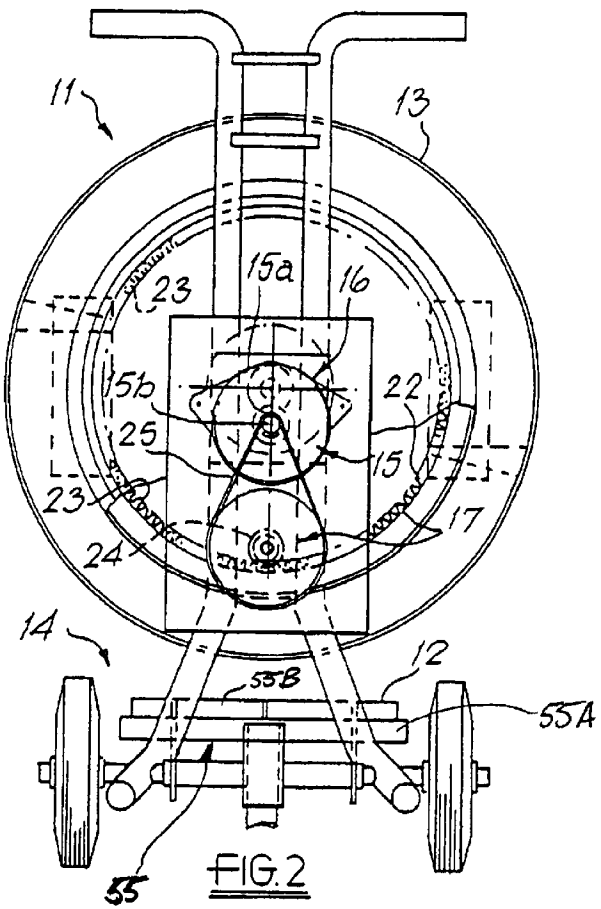
FIG. 2 is a rear view on arrow 2 of FIG. 1.
Figure 1:
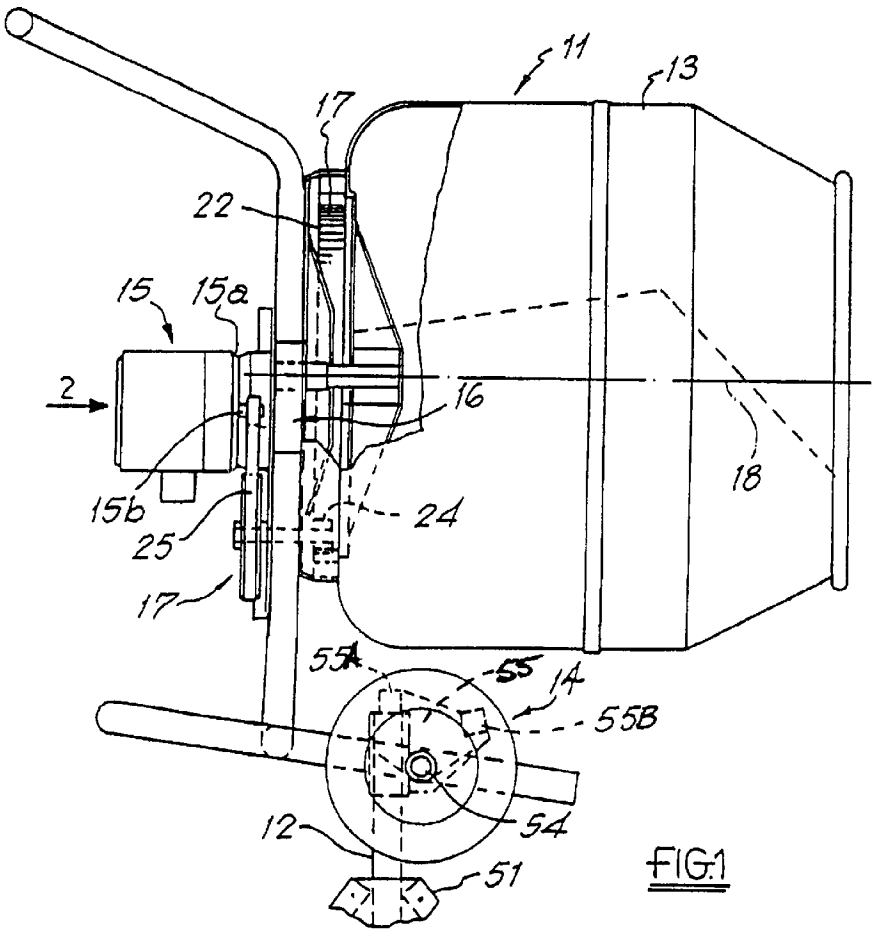
FIG. 1 is a side elevation of a first embodiment.

The drawings illustrate barrel mixers 11 comprising a support 12 for a rotary mixer barrel 13. The support 12 includes a tipping arrangement 14 for the barrel 13. The support 12 also supports a motor 15 and transmission 16 for rotating the barrel 13, the transmission 16 including step-down gearing between the motor 15 and the barrel 13, the motor 15 and gearing 17 tipping with the barrel 13.

The motor 15 is of the type having a mounting plate 15*a* surrounding the motor shaft 15*b*. The motor 15 can be an internal combustion engine such as a petrol engine of the type used to power rotary lawn mowers, or an open frame electric motor, of the type, for example, used to power washing machines. In either case, these motors are of the kind referred to as "vertical shaft motors", because in their intended situations, i.e. in rotary lawn mowers and in washing machines, their axes are vertical. In fact, the essential distinction between these vertical axis motors and commonplace motors is that the motor mounting plate surrounds the motor shaft.

FIGS. 1 to 4 illustrate a mixer in which the motor 15 is mounted with the axis of the shaft 15*b* parallel to the axis 18 of rotation of the barrel 13. The motor 15 is mounted on the mounting plate 15*a* and drives the barrel 13 through the gearing 17 which is axially parallel the motor 15 and the barrel 13. The barrel 13 has a large diameter drive ring 22 (which may be made in four sections, for example, bolted on to the bottom of the barrel) with radially inwardly directed teeth 23 meshing with a cog 24 driven directly or indirectly by the motor 15. The cog 24 is driven by a belt drive 25 from the motor shaft 15*b*, but could equally well be driven by an intermediate cog from the motor shaft 15*b*.

Figure 5:
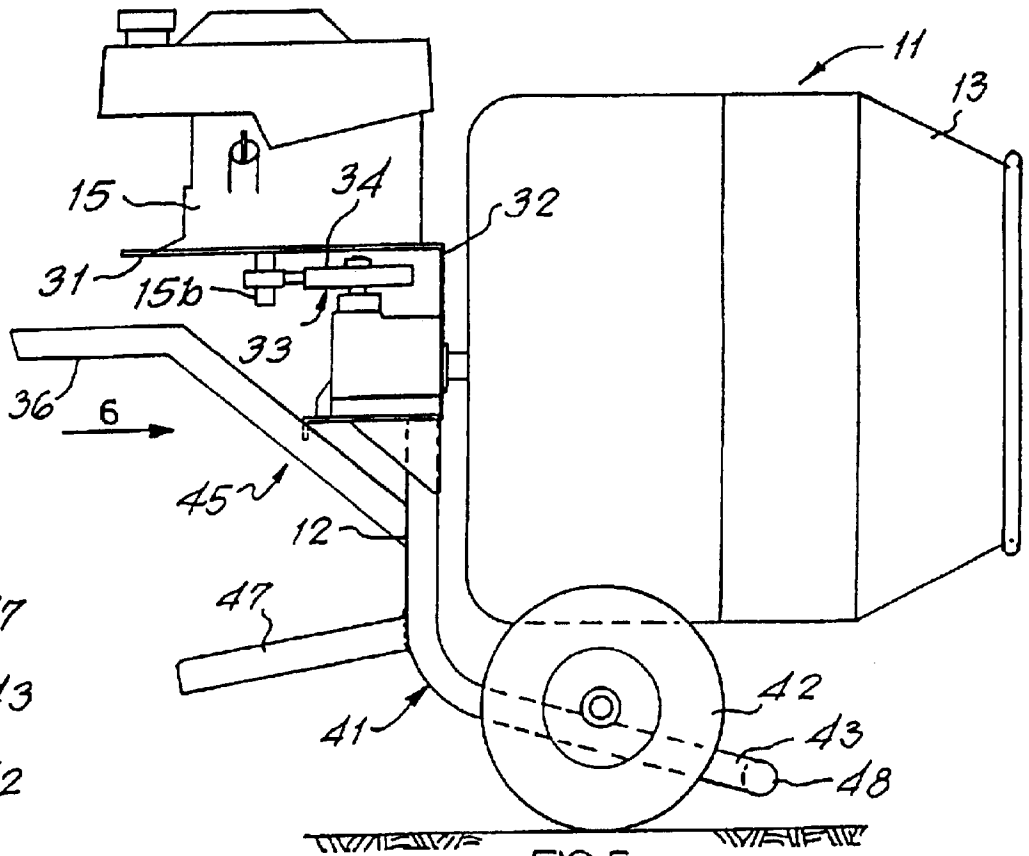
FIG. 5 is a side elevation of a second embodiment.
Figure 6:
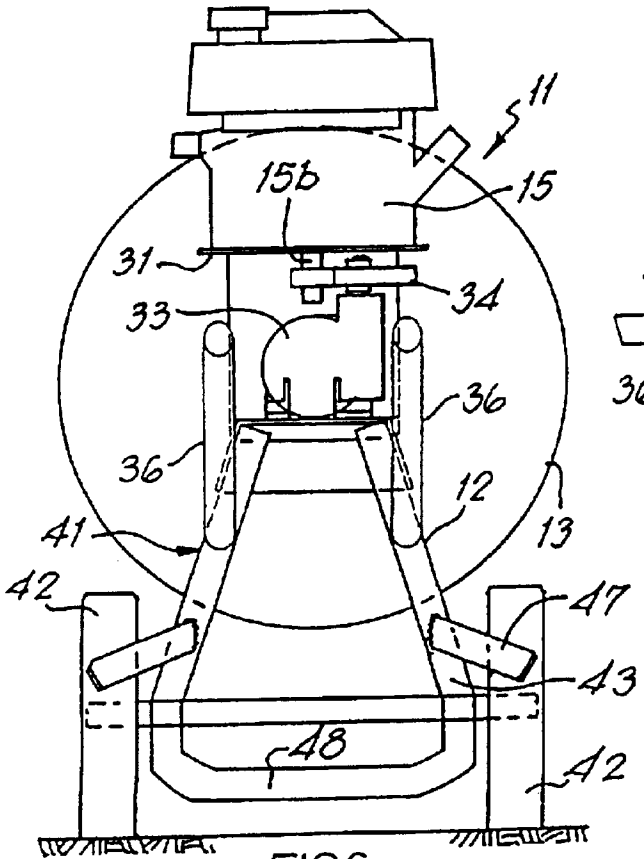
FIG. 6 is a view on arrow 6 of FIG. 5.

FIGS. 5 and 6 illustrate a mixer 11—which the motor 15 is mounted with its axis at right angles to the axis of rotation of the barrel 13. The motor 15 is mounted on a first mounting plate or frame 31 of the support 12. The barrel 13 is mounted on a second mounting plate or frame 32 and driven by means of a right-angle gear 33 connected to the motor shaft 15*b*. The right-angle gear 33 illustrated comprises a worm gear, but could equally comprise for example a bevel gear.

While the motor shaft 15*b* could, given appropriate ratio arrangements, be connected directly to the worm gear 33, in the illustrated arrangement, the motor shaft 15*b* is connected directly to the worm gear 33; the illustrated arrangement is a belt drive 34, but could equally well be a meshing cog arrangement.

In each embodiment the support 12 comprises a wheeled trolley.

In the case of the embodiment of FIGS. 5 and 6, the wheeled trolley comprises a frame 41 having wheels 42 mounted on a frame base 43, a support 44 for the barrel 13 supporting the barrel on the same side of the frame 41 as the base 43 and supporting the motor 15 and transmission 16 on the opposite side of the frame 41, and handle means 45 (comprising two handles 36) projecting from the frame 41 at the opposite end thereof to the frame base 43 and on the same side of the frame 41 as the motor 15 and transmission 16.

The frame base 43 comprises a resting surface 47 extending on the motor and transmission side of the frame 41. The mixer 11 rests on the resting surface 47 and on the wheels 42 with the barrel axis inclined upwardly for mixing beyond the wheels 42, a fulcrum 48 is present on which the mixer 11 can be tipped for pouring.

Figure 4:
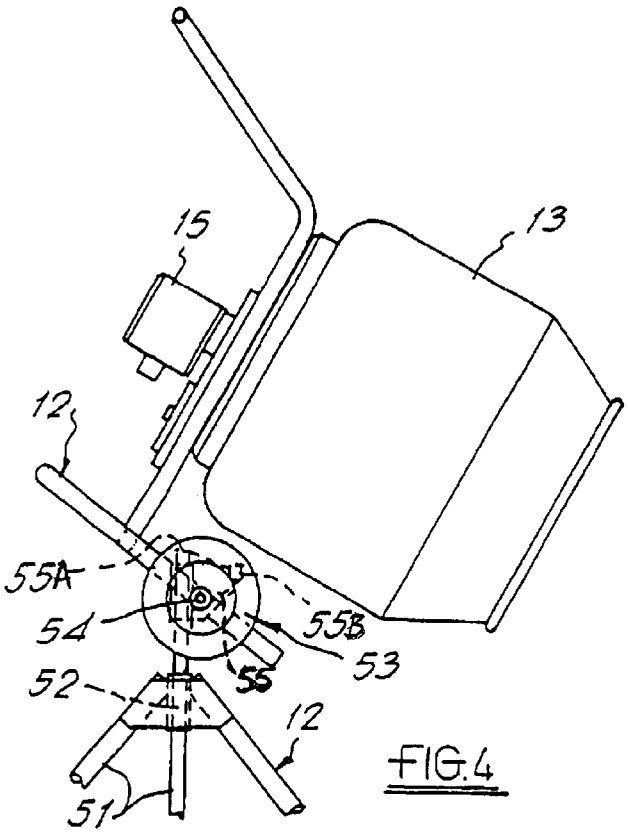
FIG. 4 is a view like FIG. 1 tipped to a pouring position.
Figure 3:
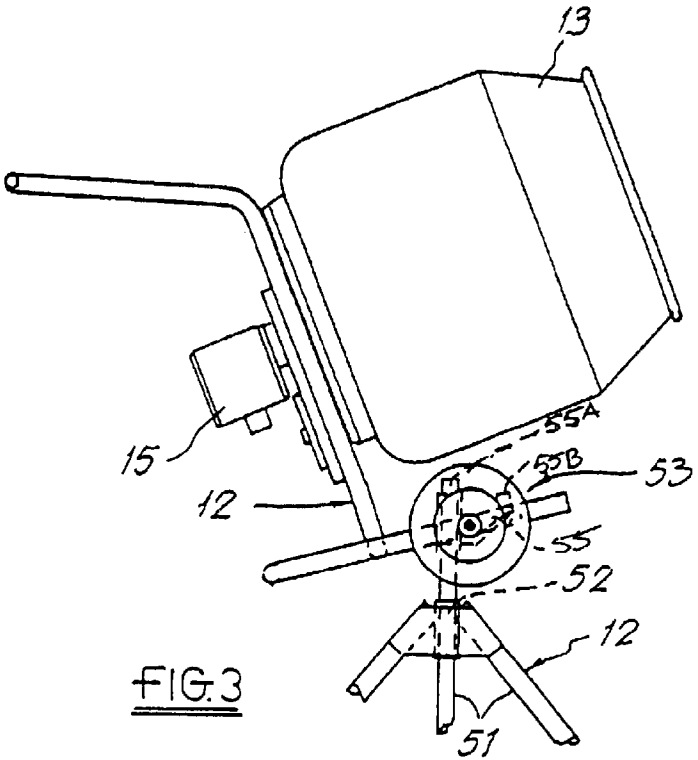
FIG. 3 is a view like FIG. 1 tipped to a mixing position.

FIGS. 1 to 4 illustrate a mixer in which the support 12 additionally comprises a stand 51 with a pintle bearing 52 receiving the trolley, and having a tipping arrangement 53 allowing the support 12 to be tipped on the pintle bearing 52 between mixing and pouring positions (FIGS. 3 and 4 respectively).

The tipping arrangement 53 comprises a fulcrum 54 on the trolley carried in a channel section on the pintle bearing 52 and having tipping limiter means 55 on the trolley abutting the pintle bearing 52 at first and second positions defining mixing and pouring positions. The tipping limiter means 55 comprises a first tipping limiting stop 55A and a second tipping limiting stop 55B.

The trolley has wheels 42 like the embodiment of FIGS. 1 to 4 by which it can be wheeled when off the stand.

The barrel in both embodiments is demountable from the support and the support breaks down to fit inside the barrel for stowage or transportation.

I claim:

1. A barrel mixer comprising:

a support means comprising a stand and a wheeled trolley, the stand having a pintle bearing provided to receive the wheeled trolley;

a rotary mixer barrel mounted on the wheeled trolley;

a motor mounted on the wheeled trolley and having an output shaft;

a transmission mounted on the wheeled trolley, the transmission receiving the output from the motor and including step-down gearing, an output from the transmission rotating the rotary mixer barrel;

a tipping arrangement, the tipping arrangement comprising a tipping limiter means, the tipping limiter means comprising first and second tipping limiting stops mounted on the wheeled trolley, and the tipping arrangement permitting the wheeled trolley to be tipped on the pintle bearing between a first position, in which the wheeled trolley engages the first tipping limiting stop, and a second position, in which the wheeled trolley engages the second tipping limiting stop; and wherein the first tipping limiting stop defines a mixing position, wherein when the wheeled trolley is in the first position the barrel is angled to retain its contents, and the second limiting stop defines a pouring position, wherein when the wheeled trolley is in the second position the barrel is angled so that its contents are poured out, and the first and second limiting stops limit movement of the barrel between the mixing and the pouring positions.

2. A barrel mixer according to claim 1, wherein the wheeled trolley comprises a frame, the barrel being supported on one side of the frame and the motor and the transmission being supported on the opposite side of the frame.

3. A barrel mixer according to claim 2, wherein the wheeled trolley further comprises a frame base and wheels mounted on the frame base, the frame base being on the same side of the frame as the barrel.

4. A barrel mixer according to claim 3, wherein the frame further comprises handle means projecting from the frame at the opposite end thereof to the frame base and on the same side of the frame as the motor and transmission.

5. A barrel mixer according to claim 1, wherein the barrel is demountable from the wheeled trolley and the support means breaks down to fit inside the barrel for storage or transportation.

6. A barrel mixer according to claim 1, wherein the wheeled trolley is supported by the stand.

7. A barrel mixer according to claim 1, wherein the wheeled trolley is demountable from the support means.

8. A barrel mixer according to claim 7, and the support means breaks down to fit inside the barrel for storage or transportation.

* * * * *